US006540490B1

(12) United States Patent
Lilie

(10) Patent No.: US 6,540,490 B1
(45) Date of Patent: Apr. 1, 2003

(54) RECIPROCATING COMPRESSOR DRIVEN BY A LINEAR MOTOR

(75) Inventor: Dietmar Erich Bernhard Lilie, Joinville (BR)

(73) Assignee: Empresa Brasileira de Compressores S/A Embraco, Joinville (BR)

( * ) Notice: Subject to any disclaimer, the term of this patent is extended or adjusted under 35 U.S.C. 154(b) by 0 days.

(21) Appl. No.: 09/786,673

(22) PCT Filed: Sep. 8, 1999

(86) PCT No.: PCT/BR99/00074

§ 371 (c)(1),
(2), (4) Date: May 31, 2001

(87) PCT Pub. No.: WO00/14410

PCT Pub. Date: Mar. 16, 2000

(30) Foreign Application Priority Data

Sep. 9, 1998 (BR) ..... 9803560

(51) Int. Cl.[7] ..... F04B 17/04; F04B 35/04
(52) U.S. Cl. ..... 417/416
(58) Field of Search ..... 417/416, 417, 417/547, 545

(56) References Cited

U.S. PATENT DOCUMENTS

| | | | | | |
|---|---|---|---|---|---|
| 3,171,585 | A | * | 3/1965 | Gauss | 417/417 |
| 3,329,334 | A | * | 7/1967 | Curwen | 219/121.36 |
| 3,788,778 | A | * | 1/1974 | Miller | 417/326 |
| 5,275,542 | A | | 1/1994 | Terauchi | 417/340 |
| 5,772,410 | A | * | 6/1998 | Chang | 417/363 |
| 5,800,139 | A | * | 9/1998 | Yamada | 417/416 |
| 5,887,507 | A | * | 3/1999 | Kaito | 417/470 |

FOREIGN PATENT DOCUMENTS

| | | | |
|---|---|---|---|
| EP | 0745773 A1 | 12/1996 | F04B/35/04 |

* cited by examiner

*Primary Examiner*—Charles G. Freay
*Assistant Examiner*—Timothy P. Solak
(74) *Attorney, Agent, or Firm*—Darby & Darby

(57) ABSTRACT

A resonant spring is transversally affixed inside a hermetic shell of a reciprocating compressor and axially coupled to a linear motor's drive rod. Two contact surfaces, defined by the drive rod and by the resonant spring, are located on orthogonal planes in relation to a cylinder's axis and are axially spaced from each other facing a respective confronting contact surface. A spacing body located between each of the confronting surfaces is loosely and coaxially mounted around the rod and has two axially opposite contact surfaces lying on orthogonal planes in relation to the cylinder's axis.

13 Claims, 7 Drawing Sheets

RECIPROCATING COMPRESSOR DRIVEN BY A LINEAR MOTOR

FIELD OF THE INVENTION

The present invention refers, in general, to a reciprocating compressor to be applied to refrigeration systems and having one or two pistons reciprocating inside a cylinder and driven by a linear motor. More specifically, the invention refers to a coupling provided between each piston and a resonant system associated therewith.

BACKGROUND OF THE INVENTION

In a reciprocating compressor driven by a linear motor and provided with one or two pistons, the gas suction and compression operations are achieved by the reciprocating axial movements of each piston inside a cylinder mounted within a hermetic shell, each piston being driven by a respective actuating means, which carries magnetic components operatively associated with the linear motor affixed to the hermetic shell of the compressor.

As known from the prior art, each piston-actuating means assembly is necessarily connected to a resonant spring affixed to the hermetic shell of the compressor, in order to operate as a guide for the axial displacement of the piston and to make the whole system act resonantly in a pre-established frequency, allowing the linear motor to be adequately dimensioned, in order to continuously supply energy to the compressor under operation.

Since the manufacturing tolerances of the resonant springs are normally much higher than the project gap provided between the piston and the cylinder, there is a need for providing a coupling between the piston-actuating means assembly and the resonant spring, in order to absorb alignment deviations between said components, so as to prevent the piston from suffering radial loads and/or bending moments and forces which may induce it to work in an inclined position when axially moving inside the cylinder, increasing the attrition with the cylinder wall and causing wear.

The resonant spring does not have a manufacturing dimensional precision to assure the piston to be perfectly centered during its reciprocating operational displacement inside the cylinder, without being submitted to radial efforts during the elastic deformations of the resonant spring in opposite axial directions during the suction and compression strokes of the piston.

In a known prior art solution, the coupling provided between the actuating means and the resonant spring is in the form of a long rod, axially arranged and having a certain previously established flexibility obtained by reducing the thickness of the rod, which results in a better absorption of alignment deviations. However, even making the rod very thin, it is not possible to completely eliminate the radial rigidity, since it is usually impossible to increase the length of the rod to a value sufficient to make irrelevant the radial efforts transmitted by said rod to the piston. Thus, radial force components will always be present, acting on the piston. On the other hand, using a thin rod may cause bending deformations in said rod during the time in which more intense axial forces are being applied thereon, that is, at the end of the suction stroke and at the beginning of the compression stroke, also causing problems of undue attrition between the piston and the cylinder.

In short, it may be said that the known solutions to provide the coupling between the piston and the resonant spring of a reciprocating compressor with a linear motor have not been sufficiently effective to absorb the angular and radial disalignments between the piston and spring axes and thus eliminate, in an economically viable way, the undue radial efforts which said coupling transfers to the piston as a function of the disalignments mentioned above.

Besides the problem related to the absorption of efforts mentioned above, the known coupling makes very difficult, when not impracticable, the tight fluid connection between a suction valve and/or a discharge valve mounted on the upper face of the piston, and a respective inlet tube provided through the wall of the hermetic shell. In this type of assembly for the suction and/or discharge valves, the connection of the valve with the outside of the hermetic shell is axially achieved through the inside of the piston body and by means of a flexible tubular connection, connecting the piston to the inlet tube provided in the wall of the hermetic-shell.

In the known constructions, the coupling does not allow, unless through very complex constructive arrangements, the tight fluid communication between the inside of the piston and a respective inlet tube provided in the wall of the hermetic shell and coupled to a refrigeration system.

DISCLOSURE OF THE INVENTION

Thus, it is an object of the present invention to provide a reciprocating compressor driven by a linear motor and having a coupling between the piston and the resonant spring, with a compact construction and which may absorb radial and angular disalignments between the piston and the spring axes, avoiding that said disalignments result in the application of radial efforts on the piston during the operation of the compressor.

It is also an object of the present invention to provide a coupling as mentioned above, which allows to establish, by means of a simple constructive arrangement, a tight fluid communication between the inside of the piston and the outside of the hermetic shell.

These and other objectives are achieved by a reciprocating compressor driven by a linear motor, comprising: a hermetic shell; a linear motor and a cylinder affixed inside the hermetic shell; at least a piston reciprocating inside the cylinder and axially affixed to an end of a rod; an actuating means coupling the piston to the linear motor; and a resonant spring transversally affixed inside the hermetic shell and axially coupled to the rod.

According to the invention, each of the parts defined by the rod and by the resonant spring has two contact surfaces lying on orthogonal planes in relation to the cylinder axis and axially spaced from each other, each of said surfaces facing a respective confronting contact surface of the other part, between each pair of confronting contact surfaces being provided a spacing body, which is loosely and coaxially mounted around the rod and has two axially opposite contact surfaces lying on orthogonal planes in relation to the cylinder axis, each of said contact surfaces being forced to seat against one of said confronting contact surfaces by means of a pair of convex surface portions, which are symmetrical and opposite in relation to the cylinder axis, each pair of convex surface portions being operatively associated with the same spacing body, with the convex surface portions thereof defining an orthogonal alignment in relation to the other pair and to the cylinder axis.

BRIEF DESCRIPTION OF THE DRAWINGS

The invention will be described below, with reference to the attached drawings, in which.

DESCRIPTION OF THE ILLUSTRATED EMBODIMENT

Figure 1:
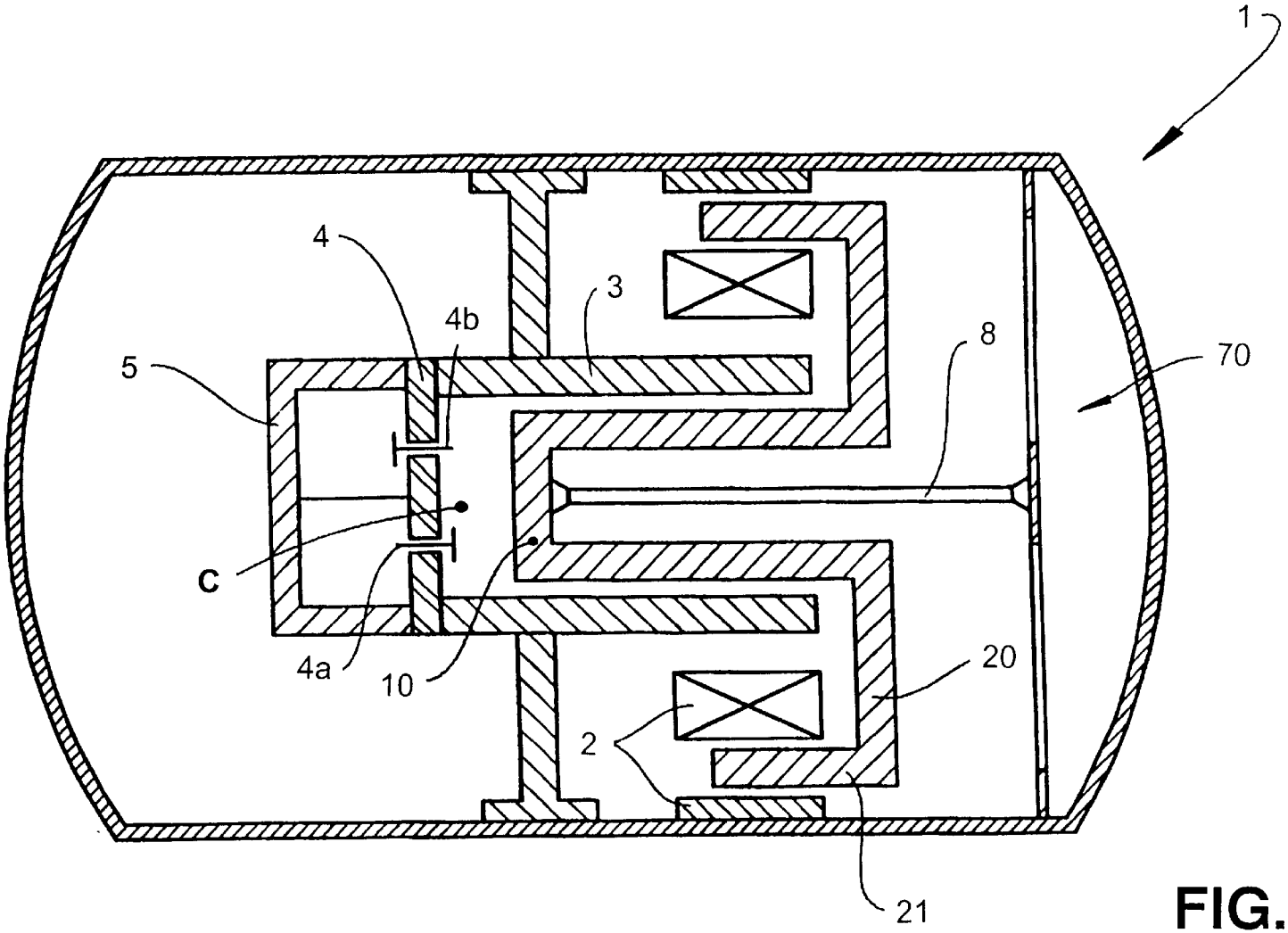
FIG. 1 (Prior Art)
FIG. 1 shows, schematically, a longitudinal diametral sectional view of part of a reciprocating compressor with a single piston driven by a linear motor and constructed according to the prior art.

As illustrated in FIG. 1, the present invention is applied to a reciprocating compressor used in refrigeration systems and comprising a hermetic shell 1, within which are affixed a linear motor 2 and a cylinder 3 lodging a piston 10 of the reciprocating type and coupled to the linear motor 2 by an actuating means 20, which is usually tubular and external to the cylinder 3 and carries a magnet 21 axially impelled upon energization of the linear motor 2.

In the embodiment illustrated in FIG. 1, the cylinder 3 has an end closed by a valve plate 4 provided with a suction valve 4*a* and a discharge valve 4*b*, allowing the selective fluid communication between the compression chamber C and the respective internal portions of a cylinder head 5, which are respectively maintained in fluid communication with the low and high pressure sides of the refrigeration system to which the compressor is coupled.

The piston 10 is coupled to a resonant spring 70, internally affixed to the hermetic shell 1 through a rod 8, which is thin, elongated, and axially disposed and dimensioned in order to cause the elastic axial deformation of the resonant spring 70 upon displacement of the piston 10.

While a construction of a compressor with a single piston 10 is being exemplarily illustrated, it should be understood that the invention may be also applied to compressors having two pistons reciprocating in opposite directions inside the cylinder 3, each being coupled to a respective resonant spring.

In the type of the prior art construction considered herein, the coupling between the piston 10 and the resonant spring 70 is defined solely by the rod 8, which has an end affixed to the piston and the opposite end affixed to the central portion of the resonant spring 70, thus being unable of avoiding that radial efforts, resulting from dimensional deformations of the resonant spring, are transmitted to the piston 10. Besides the problem of the undue transmission of radial efforts from the resonant spring 70 to the piston 10, this prior art solution of a thin rod makes complex to mount a gas conducting duct connecting the inside of the piston 10 with the outside of the hermetic shell 1, in the cases in which the upper face of the piston 10 carries one of the suction or discharge valves, as it occurs in the solution which has been disclosed and claimed in a patent application of the same applicant.

Figure 2:
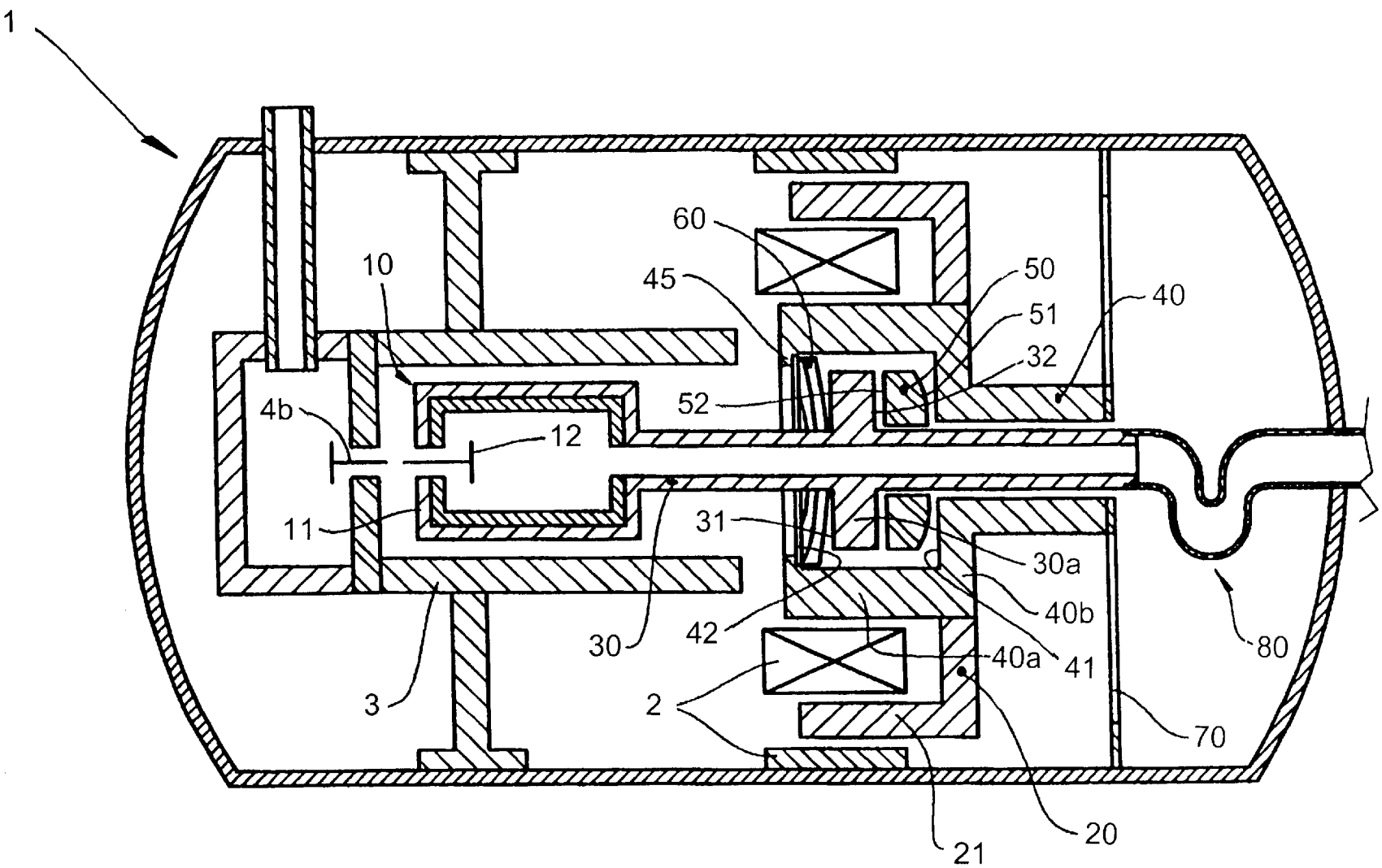
FIG. 2 shows, schematically, a longitudinal diametral sectional view of part of a reciprocating compressor with a single piston driven by a linear motor and having the rod-resonant spring coupling constructed according to a first embodiment of the present invention.
Figure 5:
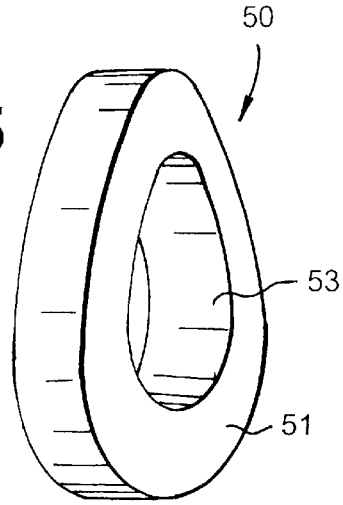
FIGS. 3, 4 and 5 show, respectively, a plan view, a lateral view and a perspective view of an embodiment for one of the spacing bodies illustrated in FIG. 2.
Figure 3:
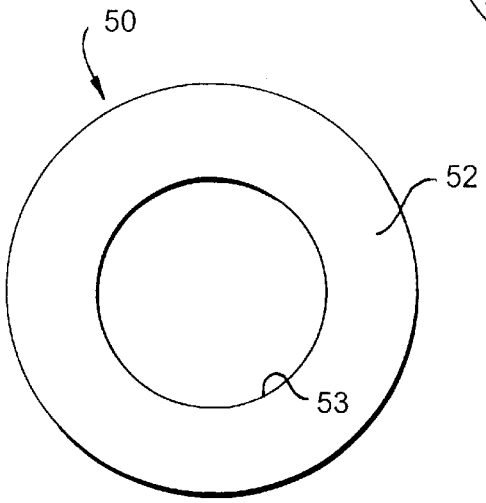
Figure 4:
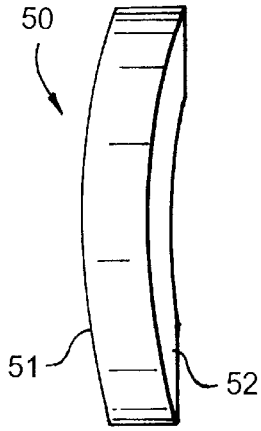
Figure 6:
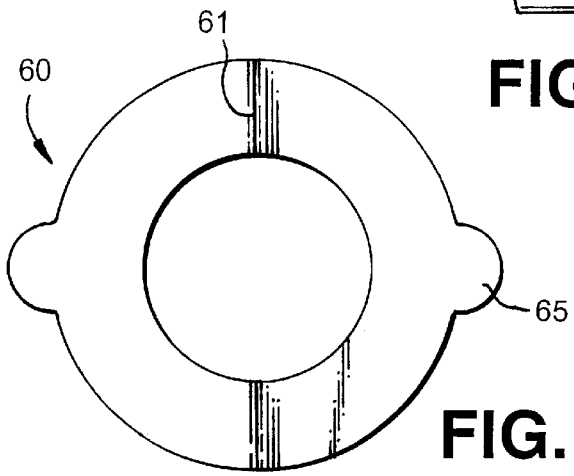
FIGS. 6 and 7 show, respectively, a plan view and a lateral view of an embodiment for the elastic means also operating as a spacing body.
Figure 7:
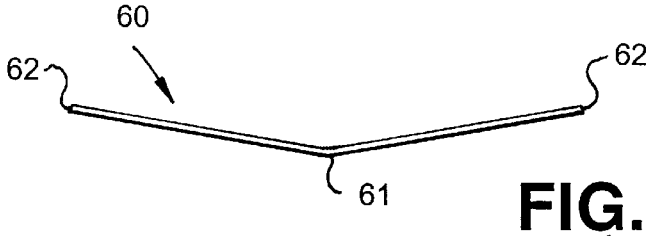

According to a first embodiment of the invention as illustrated in FIG. 2, the piston 10 is attached to an end of a rod 30, coaxial to the piston 10 and extending so as to be loosely introduced into a tubular guide 40, which is axially aligned with the axes of the cylinder 3 and resonant spring 70, said tubular guide being simultaneously attached to the latter and to the actuating means 20. The tubular guide 40 incorporates, coaxially in an end, a cylindrical tubular projection 40*a*, which has an internal diameter substantially larger than that of the tubular guide 40 and which is united to the latter through an annular portion 40*b*, whose internal annular face defines a first contact surface 41, which is flat and orthogonal to the axis of the cylinder 3.

Around the rod 30 is mounted a first spacing body 50, of annular shape, with an internal diameter larger than the external diameter of the rod 30 and with an external diameter smaller than the internal diameter of the cylindrical tubular projection 40*a*, the radial gaps between the rod 30 and the first spacing body 50 and between the latter and the cylindrical tubular projection 40*a* being dimensioned to absorb the deviations of radial and angular positioning between the rod 30 and the resonant spring 70 during operation of the compressor.

In the illustrated embodiment, the rod 30 incorporates a circumferential flange 30*a*, with an external diameter smaller than the internal diameter of the cylindrical tubular projection 40*a*, within which it is also positioned, as it occurs with the first spacing body 50. The circumferential flange 30*a* has its end opposite annular faces defining contact surfaces 31, 32, which are contained in respective planes axially spaced to each other and orthogonal to the axis of cylinder 3.

The first spacing body 50 is thus located inside the cylindrical tubular projection 40*a*, between the first contact surface 41 of the latter and the adjacent contact surface 31 of the circumferential flange 30*a*. In order that the coupling between the rod 30 and the resonant spring 70 may be achieved so as to transmit axial force to and from each other, only by the seating of contact surfaces, without allowing that angular and radial disalignments between the axes for the application of mutual axial forces by the rod and resonant spring 70 result in the application of radial forces onto the piston, the first spacing body 50 has, in each of its opposite end faces, a contact surface defined by a pair of cylindrical surface portions 51, 52, which are symmetrical and opposite in relation to the axis of cylinder 3, said cylindrical surface portions 51, 52 of each pair defining an alignment orthogonal to the alignment of both cylindrical surface portions of the other pair and being respectively seated against the first contact surface 41 of the cylindrical tubular projection 40*a* and the adjacent contact surface 32 of the circumferential flange 30*a*.

It should be understood herein that the cylindrical surface portions, with an axis orthogonal to the axis of cylinder 3, may be substituted by convex surface portions, semi-spherical for example, aiming at the same operational result.

The constructive solution, in which two pairs of cylindrical surface portions are provided mutually orthogonally and respectively seated against flat contact surfaces, for transmitting compressive axial forces between the rod 30 and the resonant spring 70, allows that the sliding and rolling between said mutually seated surfaces absorb, jointly, the radial and angular deviations in any direction, between the axes of application of said axial forces, said cylindrical surface portions being centrally and coaxially interrupted by the axial throughbore 53 of the first spacing body 50, which is of annular shape in order to permit a determined tight fluid connection between the inside of the piston and the outside of the shell, as described ahead.

In order to allow the transmission of tensile axial forces between the rod 30 and resonant spring 70, the same embodiment of FIG. 2 further foresees the provision, inside the cylindrical tubular projection 40*a* and around the rod 30, of a second spacing body 60, also of annular shape and with the same diametrical dimensionings of the first spacing body in relation to the rod 30 and to the cylindrical tubular projection 40*a* and also having two pairs of cylindrical surface portions 61, 62, which are symmetrical and opposite in relation to the axis of cylinder 3, each pair being aligned according to a direction orthogonal to that of the other pair and to the axis of cylinder 3 and being defined in one of the two opposite annular faces of the second spacing body 60. One of the pairs of the cylindrical surface portion 61 is seated against the adjacent contact surface 31 of the circumferential flange 30*a,* whereas the other pair of the cylindrical surface portion 62 is seated against an adjacent contact surface 42 defined in the inner face of an end annular lid 45 provided at the free end edge of the cylindrical tubular projection 40*a.*

Figure 8:
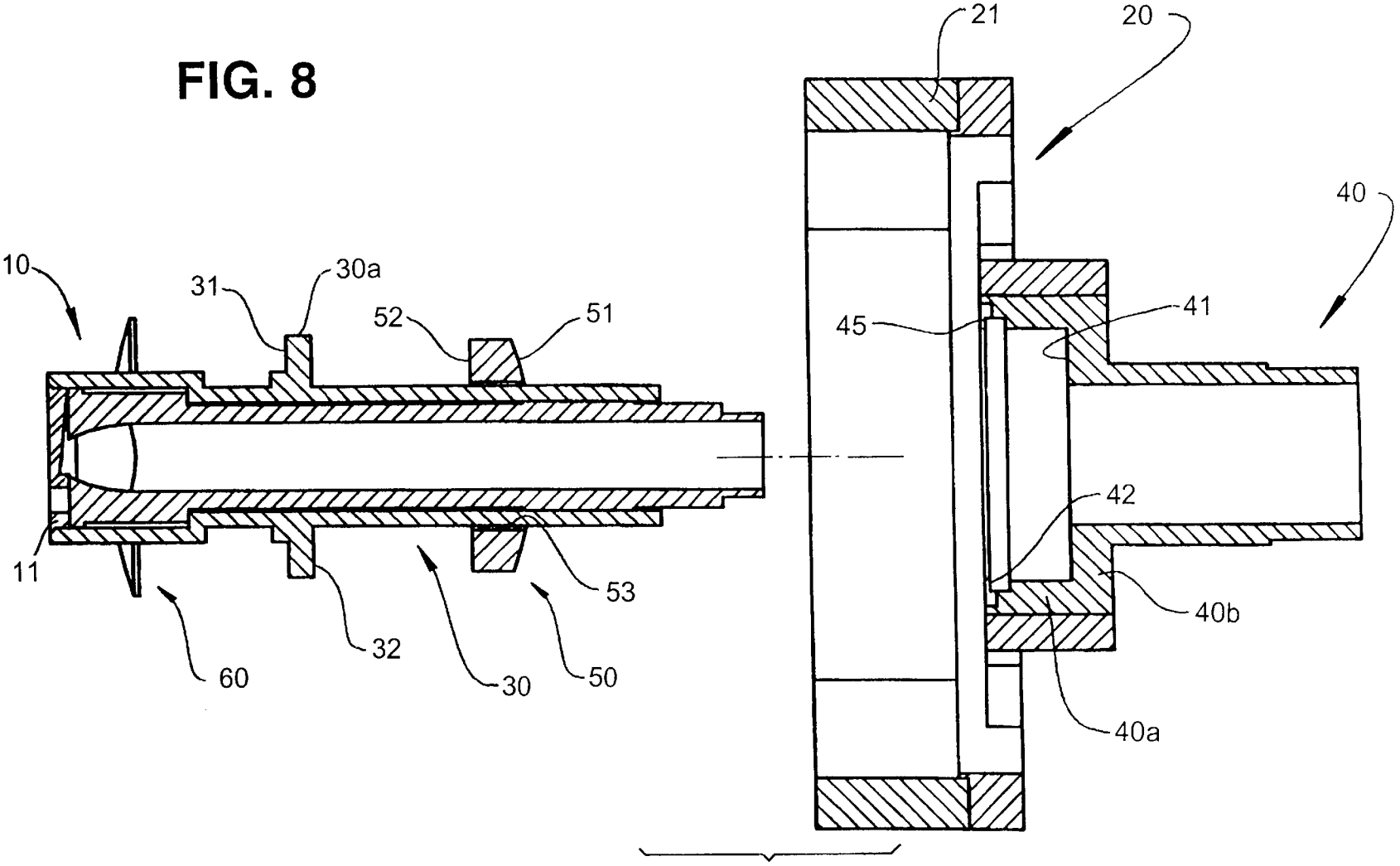
FIG. 8 illustrates a partially exploded enlarged diametral view of the assembly defined by the magnet, actuating means, rod and spacing bodies.
Figure 9:
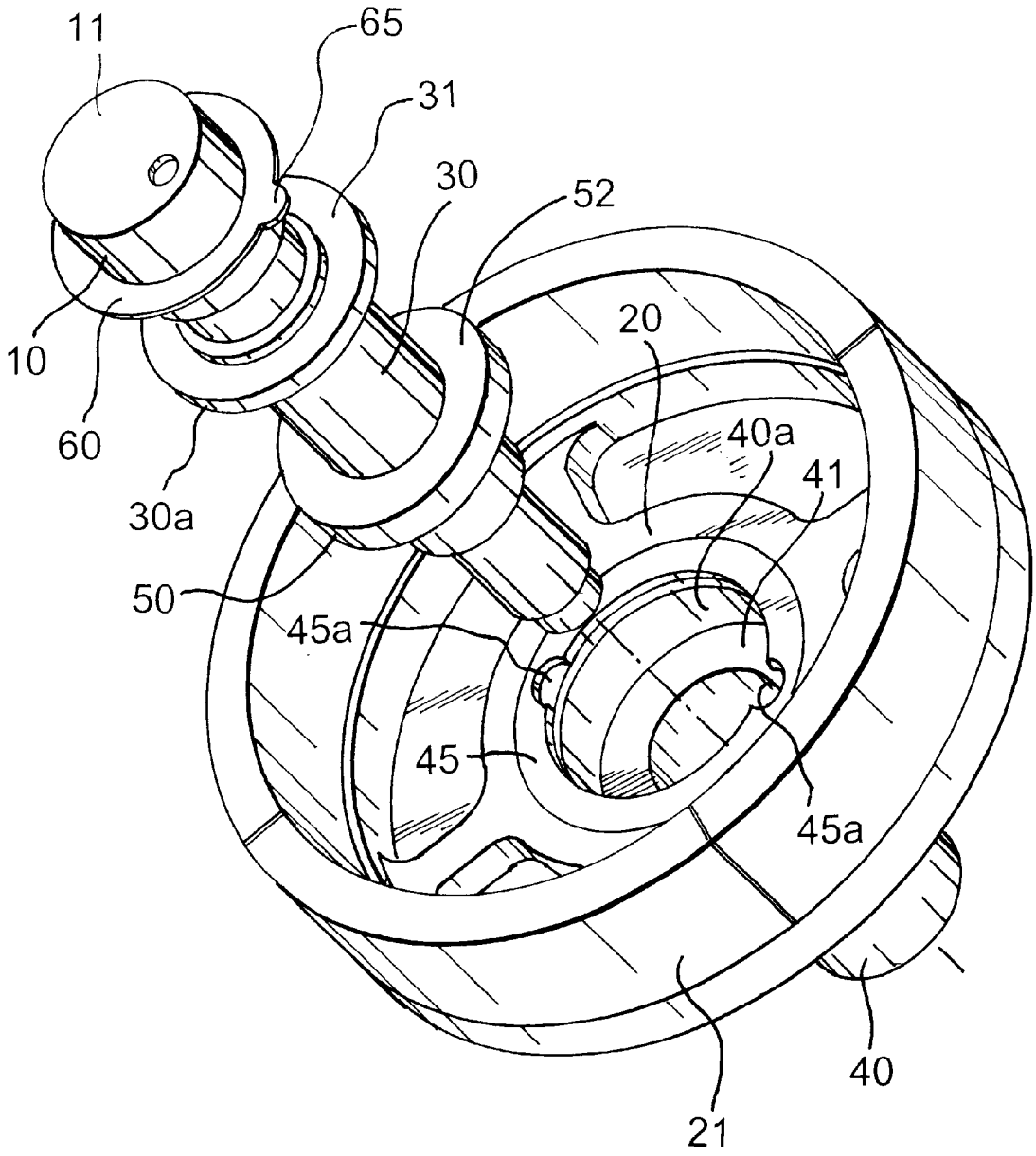
FIG. 9 is an exploded perspective view of the assembly of FIG. 8.

In the embodiment illustrated in FIGS. 2, 8 and 9, the end annular lid 45 takes the form of an annular flange, which is incorporated as a single piece to the free end edge of the cylindrical tubular projection 40*a.* However, it should be understood that this end annular lid 45 may have other forms of fixation to the cylindrical tubular projection 40*a.* In the illustrated form, the end annular lid 45 has two recesses 45*a,* which are diametrically opposite and located in its internal peripheral edge, in order to allow the second spacing body 60 to be mounted inside the cylindrical tubular projection 40*a,* as described below.

While the assembly of coupling elements between the rod 30 and resonant spring 70 permits the elimination of axial gaps between the mutually seated surfaces, at least at the time in which the compressor is ready to start its working life, it is desirable to provide an elastic means actuating simultaneously on the rod 30 and on the resonant spring 70, in order to force the contact surfaces to a constant seating during the whole operational life of the compressor.

In the embodiment illustrated in FIGS. 2, 8 and 9, the elastic means is defined by the second spacing body 60 itself, since it is responsible for the transmission of axial tensile forces only, during the operation of the compressor.

In this embodiment, the second spacing means 60 takes the form of an annular metallic blade of spring steel, which is "V" bent according to a diametral alignment and with the vertix in the form of a rounded edge, in order to define a pair of cylindrical surface portions 61 external to the "V" profile, which are symmetrical and opposite in relation to the axis of cylinder 3 and which are seated against the adjacent contact surface 31 of the circumferential flange 30*a,* said annular metallic blade incorporating, in the face internal to the "V" profile and orthogonally to the alignment of the two cylindrical surface portions 61, another pair of convex surface portions 62, which are obtained, for example, by semi-spherical bosses incorporated in a pair of ears 65, external and diametrically opposite, or by the convex edges of these ears 65. The assembly of the second spacing body 60 is achieved so as to keep it axially pressed between the circumferential flange 30*a* of the rod 30 and the end annular lid 45 of the cylindrical tubular projection 40*a,* eliminating possible axial gaps that occur during assembly or due to wear between the mutually contacting surfaces. In the illustrated embodiment, the assembly of the second spacing body 60 is achieved by making its ears 65 pass through the recesses 45*a* of the end annular lid 45 and thereafter rotating the second spacing body 60, so that the respective pair of convex surface portions 62 be supported against the contact surface 42 defined in the inner face of the end annular lid 45.

Also as illustrated in FIG. 2, the coupling for the rod and resonant spring of the present invention achieved by seating pairs of convex surface portions against flat contact surfaces is particularly desired for obtaining a higher distribution of contact loads between said surfaces, in the cases in which the piston 10 carries, on its top face 11, a suction valve 12 (or a discharge valve), to be maintained in a tight fluid communication with the outside of the hermetic shell 1, through a duct defined by the rod 30 itself in a tubular shape and by a portion 80 extending through the wall of the hermetic shell and being at least partially flexible in order to conform to the displacement of the piston 10.

Figure 10:
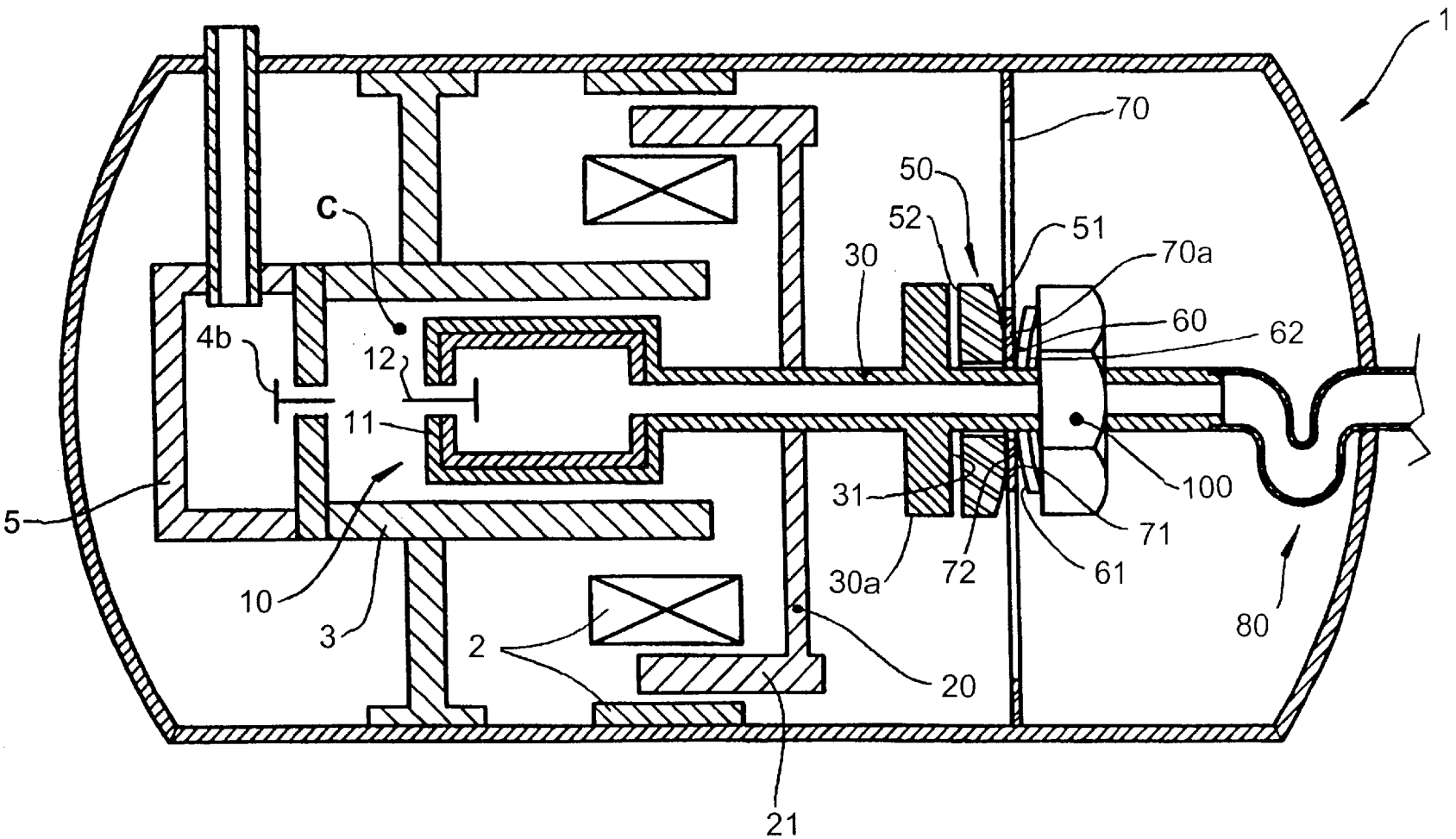
FIG. 10 is a similar view to that of FIG. 2, but illustrating a second embodiment of the present invention.

In the embodiment illustrated in FIG. 10, the actuating means 20 is directly coupled to the rod 30, which is also tubular and has a free end portion loosely provided through a central annular hub 70*a* of the resonant spring 70, said hub being coaxially aligned in relation to the axis of cylinder 3 and presenting opposite end annular faces defining respective contact surfaces 71, 72, lying on planes axially spaced from each other and orthogonal to the longitudinal axis of cylinder 3. The rod 30 incorporates a circumferential flange 30*a,* whose end annular face, turned to the annular hub 70*a,* defines a first contact surface 31, which is flat and orthogonal to the axis of cylinder 3 and which is axially spaced from the confronting contact surface 72 of the annular hub 70*a.* Around the rod 30, and between the circumferential flange 30*a* and the annular hub 70*a,* is mounted a first spacing body 50, with a similar construction to that described in relation to the embodiment illustrated in FIG. 2 and having its cylindrical surface portions 51, 52 respectively seated agaisnt the first contact surface 31 and against the adjacent contact surface 72 of the annular hub 70*a.*

In this embodiment of FIG. 10, the end portion of the rod 30 projecting through the annular hub 70*a* receives a second spacing body 60, with a similar construction to that described in relation to FIG. 2, and an end stop 100, which may take the form of a nut, which may be adjustably affixed around the rod 30, in order to press the second spacing body 60, made of spring steel, against the annular hub 70*a,* and to press the latter towards the circumferential flange 30*a,* eliminating possible axial gaps between the mutually seated surfaces.

Further to the embodiment illustrated in FIG. 10, it should be understood that the circumferential flange 30*a,* the annular hub 70*a* or even the end stop 100 may incorporate a cylindrical tubular projection similar to that illustrated in FIG. 2 and designed to operate as a limiting means of relative radial displacement between the parts under a compressive contact for transmitting an axial force.

Figure 11:
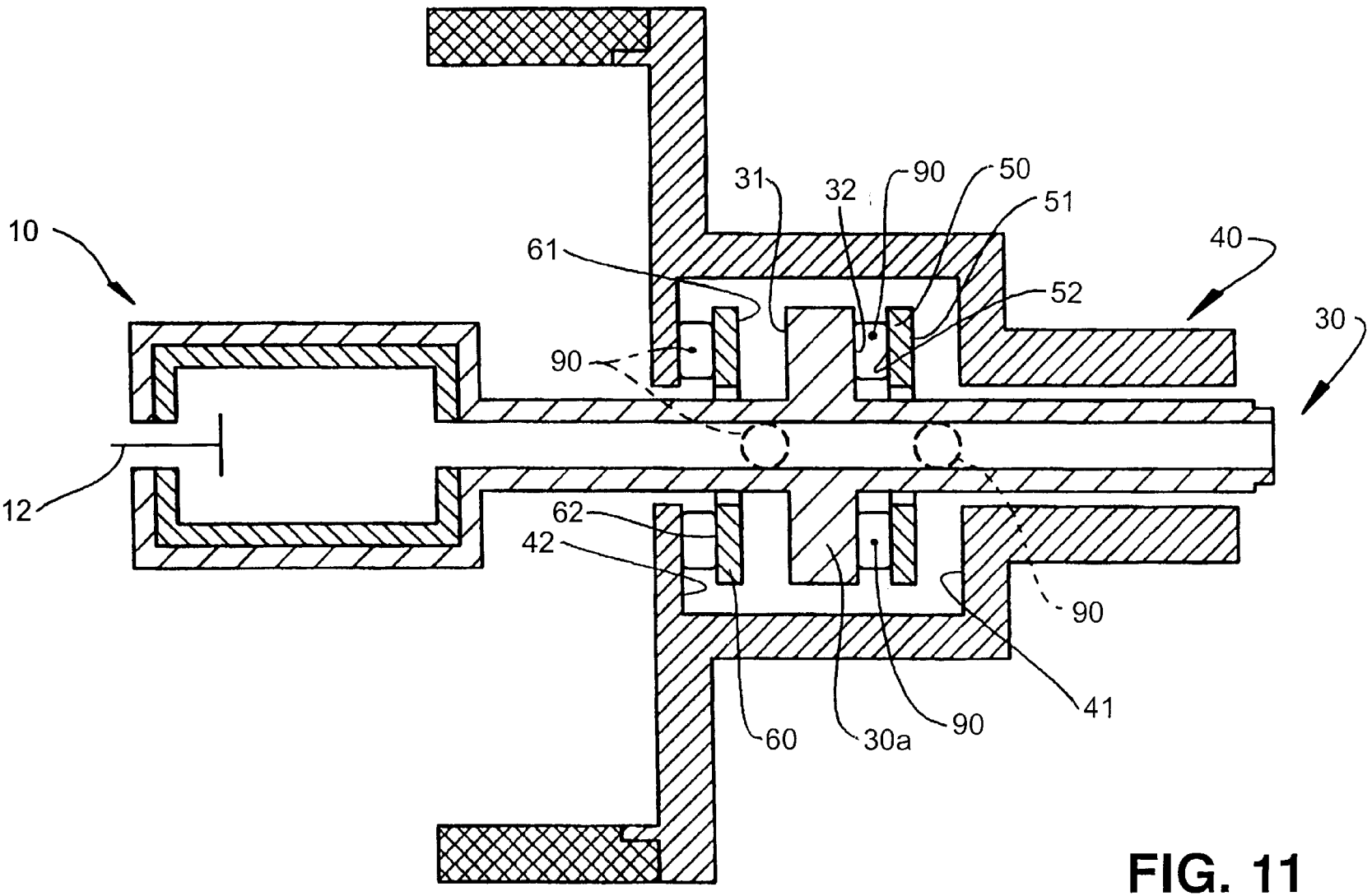
FIG. 11 is a schematic view, illustrating another embodiment for the coupling between the piston and the resonant spring.

Another constructive embodiment is illustrated in FIG. 11. In this construction, derived from that one shown in FIG. 2, both spacing bodies 50, 60 take the form of washers, in which their contact surfaces 51, 52; 61, 62 are flat, axially opposite and lying on orthogonal planes to the axis of cylinder 3, each pair of convex surface portions being defined by a pair of cylindrical rollers 90 symmetrically and oppositely arranged in relation to the axis of cylinder 3 according to an orthogonal alignment in relation to the latter and to the alignment of the other pair of cylindrical rollers 90 operatively associated with the same spacing body 50, 60.

Each pair of cylindrical rollers 90 is disposed in order to be simultaneously seated on one of the contact surfaces 51, 52; 61, 62 of one of the spacing bodies 50, 60 and on the adjacent confronting contact surface 41, 42, 72, 31, 32.

The adequate positioning of the cylindrical rollers 90 may be obtained by different manners, such as, for example, through annular bearing supports, nonillustrated, which may be inscribed or circumscribed in relation to each pair of cylindrical rollers 90.

What is claimed is:

1. A reciprocating compressor driven by a linear motor, comprising:

a hermetic shell (1); a linear motor (2) and a cylinder (3) affixed inside the hermetic shell (1); at least a piston (10) reciprocating inside the cylinder (3) and axially affixed to an end of a rod (30); an actuating means (20) coupling the piston (10) to the linear motor (2); and a resonant spring (70) transversally affixed inside the hermetic shell (1) and axially coupled to the rod (30), characterized in that the rod (30) and the resonant spring (70) each has two contact surfaces (41, 42, 72; 31, 32) lying on orthogonal planes in relation to the axis of cylinder (3) and axially spaced apart, each of said contact 11 surfaces facing a respective confronting contact surface (51, 62; 61,52) a spacing body (50, 60), between each pair of said contact surfaces, which is loosely and coaxially mounted around the rod (30) wherein a gap is formed between the rod and the spacing body (50,60) so dimensioned to absorb the deviations of radial and angular positioning between rod 30 and resonant spring 70 during operation of the compressor and has two of said confronting contact surfaces (51, 52; 61, 62) axially opposite to each other and lying on orthogonal planes in relation to the axis of cylinder (3), whereby each of said confronting contact surfaces is forced to seat against one of said contact surfaces (41, 32; 31, 42, 72) because of the shape of a pair of convex surface portion of said confronting contact surfaces, which are symmetrical and opposite in relation to the axis of cylinder (3), each one of the pair of convex surface portions being operatively associated with the same spacing body (50, 60), with the convex surface portions thereof defining an orthogonal alignment in relation to the other one of the pair of convex surface portions and to the axis of cylinder (3).

2. Compressor, as in claim 1 characterized in that the convex surface portions are defined by the axially opposite contact surfaces (51, 52; 61, 62) of the spacing bodies (50, 60).

3. Compressor, as in claim 1, characterized in that the convex surface portions are defined by cylindrical surface portions with an axis orthogonal to the axis of cylinder (3).

4. Compressor, as in claim 1, characterized in that the convex surface portions are defined by spherical surface portions.

5. Compressor, as in claim 1, characterized in that it comprises an elastic means (60) simultaneously actuating on the resonant spring (70) and on the rod (30), in order to constantly force the convex surface portions (51, 52; 61, 62) against the adjacent contact surfaces (41, 32; 31, 72).

6. Compressor, as in claim 5, characterized in that the elastic means (60) is defined by one of the spacing bodies.

7. Compressor, as in claim 6, characterized in that the elastic means (60), in the form of a spacing means, comprises an annular metallic blade made of spring steel and diametrically bent in the shape of a "V", with the vertix in the form of a rounded edge defining a convex surface portion (61), said blade incorporating, on its opposite side, another convex surface portion (62) with the axis being orthogonal to the first convex surface portion and formed as a pair of ears (65), external and diametrically opposite to each other.

8. Compressor, as in claim 1, characterized in that at least one of the spacing bodies (50) has an annular shape with its opposite annular faces each having a contact surface (51, 52) defined by two convex surface portions, the convex surface portion of one of the annular faces being aligned according to an orthogonal direction in relation to the alignment of both convex surface portions of the other annular face.

9. Compressor, as in claim 1, characterized in that the spacing body (50,60) consists of two spacing bodies, and wherein the two spacing bodies, the rod (30) and the resonant spring (70) are centrally and coaxially perforated in order to form said loose mounting to the rod (30) and wherein duct (30, 80) includes the rod and is flexible in at least part of the extension thereof, connecting the inside of piston (10) with the outside of the hermetic shell (1).

10. Compressor, as in claim 1, characterized in that the spacing body (50, 60) consists of a first (50) and a second (60) spacing body and wherein said first and second spacing bodies are subjected to a radial displacement limiting means, which is coupled to one of the parts defined by the rod (30) and resonant spring (70).

11. Compressor, as in claim 10, characterized in that the radial displacement limiting means is defined by a cylindrical tubular projection **(40*a*) of enlarged diameter receiving internally the first and the second spacing bodies (50, 60) and being affixed, at one end, to a tubular guide (40) of the rod (30), said guide being affixed to the resonant spring (70)**.

12. Compressor, as in claim 1, characterized in that each pair of convex surface portions is defined by a pair of cylindrical rollers (90), which are symmetrical and opposite in relation to the axis of cylinder (3) and arranged according to an alignment orthogonal to said axis and to the alignment of another pair of cylindrical rollers (90) operatively associated with the same spacing body (50, 60), each pair of cylindrical rollers (90) being simultaneously seated on one of the contact surfaces (51, 52; 61, 62) of a spacing body (50, 60) and on the confronting contact surface (41, 42, 72, 31, 32) adjacent to said spacing body.

13. Compressor, as in claim 12, characterized in that the spacing bodies (50, 60) are washers with their contact surfaces (51, 52; 61, 62) being flat and axially opposite on planes orthogonal to the axis of cylinder (3).

* * * * *